United States Patent [19]

Braus et al.

[11] Patent Number: 4,753,441

[45] Date of Patent: Jun. 28, 1988

[54] WAR GAME WITH VARIABLE GAME BOARD

[76] Inventors: Matthew P. Braus, 9 Lagonda St., Morgan City, La. 70380; George Spector, 233 Broadway, RM 3615, New York, N.Y. 10007

[21] Appl. No.: 874,570

[22] Filed: Jun. 16, 1986

[51] Int. Cl.[4] ..... A63F 3/04; A63F 3/00

[52] U.S. Cl. ..... 273/255; 273/261; 273/291; 273/284

[58] Field of Search ..... 237/260, 262, 255, 284, 237/282 R, 272, 291, 282 B, 282 C

[56] References Cited

U.S. PATENT DOCUMENTS

| | | | |
|---|---|---|---|
| 1,165,688 | 12/1915 | Maris | 273/262 |
| 1,578,554 | 3/1926 | Seligman | 273/272 |
| 2,290,669 | 7/1942 | Bowie | 273/255 |
| 2,342,899 | 2/1944 | Sonds, Jr. | 273/260 |
| 3,343,841 | 9/1967 | Arend | 273/262 |

*Primary Examiner*—Richard C. Pinkham
*Assistant Examiner*—William E. Stoll

[57] ABSTRACT

A decoy board game is provided including a gameboard with a grid pattern divided into four segments defining discrete squares of different representations, such as water, land, mountain, island, starting, headquarter and airstrip in which four players can play the game. The players are provided with four sets of game pieces adapted for movement along the grid pattern formed by the squares. Each set of playing pieces includes six different types of pieces having predetermined movements and capable of removing an opponents pieces in accordance with rules of the game and by result of a random number generator.

3 Claims, 1 Drawing Sheet

WAR GAME WITH VARIABLE GAME BOARD

BACKGROUND OF THE INVENTION

The instant invention relates generally to war games and more specifically it relates to a decoy board game.

Numerous war games have been provided in prior art that are adapted to be played on a board. For example, U.S. Pat. Nos. 3,343,841; 3,831,944 and 4,373,731 all are illustrative of such prior art. While these units may be suitable for the particular purpose to which they address, they would not be as suitable for the purposes of the present invention as heretofore described.

SUMMARY OF THE INVENTION

A primary object of the present invention is to provide a decoy board game that will overcome the shortcomings of the prior art devices.

Another object is to provide a decoy board game that has two objectives during the play of the game in which one is to conquer opposing armies and by doing so build up your army and two is to hide your president and keep him from being captured.

A further object is to provide a decoy board game that requires luck, strategy and memory to play the game.

A still further object is to provide a decoy board game in which the game board has movable and color changable squares thereon.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
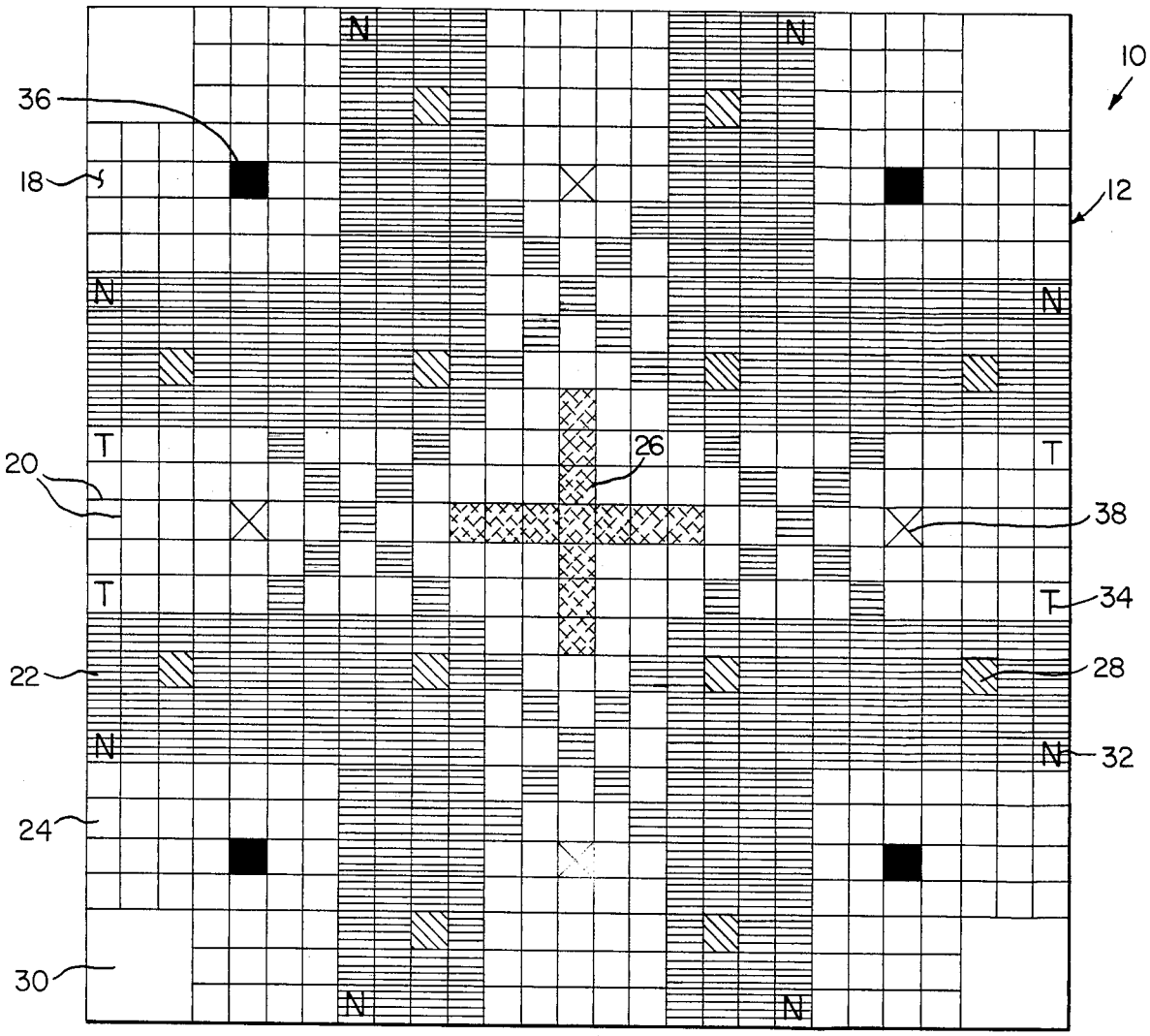
FIG. 1 is a top plan view of the game board.
Figure 2:
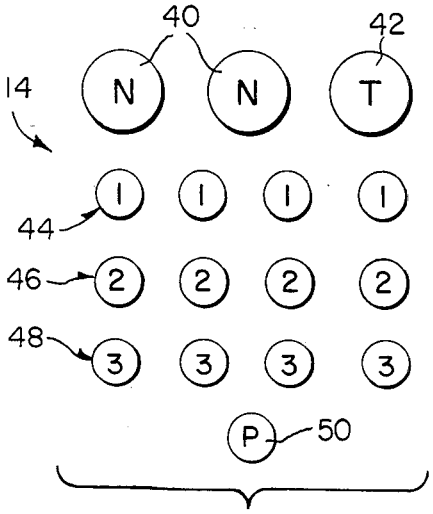
FIG. 2 is a top plan view of one of four sets of game pieces.
Figure 3:
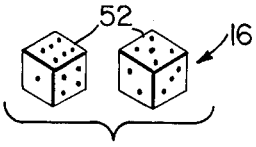
FIG. 3 is an illustration of the dice.

Turning now descriptively to the drawings, in which similar reference characters denote similar elements throughout the several views, FIGS. 1 through 3 illustrate a decoy board game 10 that includes a gameboard 12, one of four sets of game pieces 14 and a random number generator 16.

The gameboard 12 has a playing surface 18 overlaid with a grid pattern 20. The grid pattern is divided into four segments defining water squares 22, land squares 24, mountain squares 26, island squares 28, starting squares 30, 32 and 34, headquarter squares 36 and airstrip squares 38 so that four players can play the game 10.

Each set of game pieces 14 define two naval ships 40, one tank 42, four number one spies 44, four number two spies 46, four number three spies 48 and a president 50. The game pieces are adapted for movement within prescribed squares on the gameboard 12. The random number generator 16 is a pair of dice 52 for indicating amount of movement for the game pieces 14 on the gameboard 12.

Each of the water squares 22, land squares 24, mountain squares 26, island squares 24, starting squares 30, 32 and 34, headquarter squares 36 and airstrip squares 38 are uniquely identified by having their own identifiable indicia thereon such as different colors. Each of the sets of game pieces 14 are uniquely identified by having their own identifiable indicia thereon, such as different colors for each set.

Figure 5:
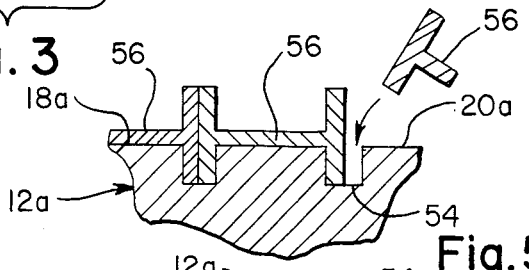
FIG. 5 is a cross sectional view taken along line 5—5 in FIG. 4 showing the tracks within the modified gameboard.
Figure 4:
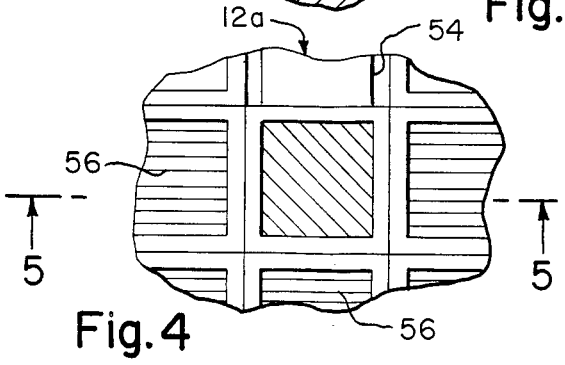
FIG. 4 is an enlarged top plan view of a portion of a modified gameboard having movable and color changable squares thereon.

FIGS. 4 and 5 show a modification wherein the gameboard **12*a* includes a plurality of intersecting tracks 54 formed within the grid pattern 20*a* on the playing surface 18*a*. A plurality of squares 56 are provided with each having a different identifiable indicia, such as color, on an opposite side thereof. The squares 56 are able to fit within the intersecting tracks 54 from either of the opposite sides, so that the squares 56 can be interchangable, varying the grid pattern 20*a* upon the playing surface 18*a***.

Instructions For P1aying The Game·

Object of the Game

1. Capture opposing players president game piece 50 taking that player out of the game.

2. Keeping your president game piece 50 from being captured by hiding him among your other game pieces.

At the beginning of the game naval ship game pieces 40 and tank game pieces 42 are placed on their starting squares 32 and 34 respectively. Spy game pieces 44, 46, 48 and president game pieces 50 are placed face down in their starting squares 30. On a roll of the dice 52 a player moves his game pieces toward the opposing players game pieces crossing land and sea.

Movement of Game Pieces

A game piece can move in any direction but cannot hit the same square twice in the same dice-roll. No game piece can move over or through another game piece. The game piece must capture another game piece or go around it. On a roll of the dice 52, a player may move one game piece or split the roll amoung two game pieces. On a roll of double three's a player can roll the dice 52 again.

Spy game pieces 44, 46 and 48 can move on land or water, each water square 22 counts as two moves for a spy game pieces. EXAMPLE—on a roll of four a spy game piece can move two water squares 22. Spy game pieces 44, 46 and 48 can only capture other spy game pieces or a president 50. The preceedure for capture is as follows: When a spy game piece lands on another spy game piece they are both flipped over to expose their numbers. A one captures a two, a two captures a three, a three captures a one, a president captures a president, and a one, two, three captures a president. If the two spy game pieces are the same it is a draw and they are flipped back over. This is where memory comes to play. Tank game pieces 42 can move only on land squares 24 and cannot move through mountain squares 26. Tank game pieces can capture other tank game pieces 42 or spy game pieces 44, 46 and 48 by landing on their square. Navel ship game pieces 40 can move only on water squares 22, whereby each water square counts as one square for a ship. A navel ship game piece 40 cannot move through or over an island square 28. The starting square 30 counts as one square. If an opposing spy game piece lands in this square and a president 50 is in it, the spy game piece can capture the president. Navel ship game pieces 40 can capture other navel ship game pieces 40 or spy game pieces 44, 46 and 48 by landing on their square.

A headquarters square 36 can be captured by landing on it. The victor player may flip over any two spy game pieces of the victim player he wishes. These two spy game pieces must remain exposed through the game. Located on the gameboard 12 are four squares 38 marked by an "X". These are air strips. If a spy game piece lands on an airstrip the spy game piece may be transported to another airstrip on the gameboard. A tank game piece 42 cannot be transported but can block an airstrip by sitting on an airstrip square 38. Located in the center of the gameboard 12 are a series of mountain squares 26. A tank game piece 42 cannot capture a spy game piece occupying a mountain square, but landing on these is tricky business. Upon landing on a mountain square 26, a player will roll one die 52, the player must roll a one or a two to stay there, otherwise that game piece is taken off the gameboard 12. Located within the water squares 22 are a series of island squares 28. To escape from a navel ship game piece 42 a spy may land on one of these. The preceedure for staying is the same as a mountain square 26. You must roll a one or a two to stay. Upon capturing an opponents players president 50, that player is out of the game and the remaining game pieces become the winning players. The game is continued until there is one player left being the winner.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A war board game comprising:

(a) a gameboard having a playing surface overlaid with a grid pattern, said grid pattern divided into four symmetrical segments including water squares, land squares, mountain squares, island squares, starting squares, headquater squares and airstrip squares, so that four players can play said game;

(b) four sets of game pieces, each set for one of said players having indicia on one side defining two naval ships, one tank, four number one spies, four number two spies, four number three spies, and a president, each said game piece adapted for specified movement restricted to prescribed squares on said gameboard;

(c) a random number generator for indicating amount of movement for said game pieces on said gameboard, wherein each of said water squares, land squares, mountain squares, island squares, starting squares, headquater squares and airstrip squares are uniquely identified by having their own identifiable indicia thereon, wherein each of said sets of game pieces are uniquely identified by having their own identifiable indicia thereon, wherein said gameboard further comprises:

(d) a plurality of intersecting straight tracks; and (e) a plurality of removable squares each having a different identifiable indicia on an opposite side thereof, said squares being able to fit abuttingly within said intersecting tracks to form said grid pattern from either of said opposite side so that said squares can be interchangable to vary the type movement over said grid pattern and thereby modifying the complexity of the game.

2. A gams as in claim 1, wherein said game piece has indicia on an opposite side which determines the capturing game piece when similar opposing game piece land on the same square.

3. A game piece as in claim 2, wherein each of said squares includes a pair of spaced vertical parallel sides which fit abuttingly against opposing sides of adjoining squares within said tracks.

* * * * *